US006305827B1

(12) United States Patent
Nölle

(10) Patent No.: US 6,305,827 B1
(45) Date of Patent: Oct. 23, 2001

(54) TRANSPORTABLE LAMP

(76) Inventor: Jürgen Nölle, Ginsterstrasse 5, D-47495 Rheinberg (DE)

( * ) Notice: Subject to any disclaimer, the term of this patent is extended or adjusted under 35 U.S.C. 154(b) by 0 days.

(21) Appl. No.: 09/590,995

(22) Filed: Jun. 9, 2000

(30) Foreign Application Priority Data

Jun. 11, 1999 (DE) ..... 299 10 204 U

(51) Int. Cl.[7] ..... F21V 17/06

(52) U.S. Cl. ..... 362/352; 362/96; 362/189; 362/399

(58) Field of Search ..... 362/352, 399, 362/806, 96, 189

(56) References Cited

U.S. PATENT DOCUMENTS 5,791,773 * 8/1998 Babineaux ..... 362/352
5,893,636 * 4/1999 Babineaux ..... 362/352

FOREIGN PATENT DOCUMENTS 0 834 693 9/1997 (EP) .

* cited by examiner

*Primary Examiner*—Thomas M. Sember
(74) *Attorney, Agent, or Firm*—Collard & Roe, P.C.

(57) ABSTRACT

A transportable lamp 1 comprises at least one lighting device, which is received in a holding device 2 and acted upon by voltage via a feed cable. The lighting device has an at least partly transparent lamp screen. So that the lamp screen 3 can be continuously and safely opened, a holding device is designed in the form of a bar and at least partly enclosed by the lamp screen. The lamp screen is held by movable tensioning means which, during use, are moved away from the lighting device, abutting the curvature of the lamp screen. Continuous and safe opening of the lamp screen is achieved under difficult working conditions, because the lamp is extremely robust and insensitive to damage.

15 Claims, 3 Drawing Sheets

TRANSPORTABLE LAMP

BACKGROUND OF THE INVENTION

1. Field of the Invention

The invention relates to a transportable lamp consisting of at least one lighting means which is received in a holding device, and to which voltage is admitted via a cable feed line, whereby an at least partly transparent lamp screen is arranged around the lighting means.

2. The Prior Art

Transportable lamps of said type are known as hand-held or standing lamps and are preferably used for temporarily lighting rooms or outdoor areas. Such lamps may be lamps with a low output or also lamps with up to 1000 watts or more output depending on the intended purpose of application. The more powerful lamps are preferably used outdoors for lighting, for example a construction site, locations where an accident or extensive damage occurred, or at sports events.

A lamp equipped with a balloon is known, for example from European patent application EP 0 834 693, in connection with which the balloon screen or shade is used for diffused scattering of the light, and an excess pressure is generated within the balloon shade by a compressor arranged on the inside. The balloon screen is initially tensioned due the excess pressure and the pressure in the balloon is measured by means of suitable pressure sensors. With adequate inside pressure, the lighting means is switched on or off via a safety circuit. It was found in the operation of such a lamp that the balloon screen can get very easily damaged depending on for which purpose the lamp is used, with cracks or holes being caused, for example by metal chips flying about in the construction industry, or by glowing ashes in fire fighting operations. Smaller holes or cracks in the textile balloon shade will not have any influence on the lighting; however, the pressure loss leads to premature shutoff of the lamp by the pressure difference sensor. Even smaller cracks and scores in the diffusion screen caused by regular packing, set-up and dismounting of the portable lamp lead to the fact that the final pressure required for switching on the lamp is no longer reached. The compressor arranged within the balloon screen is in fact capable of compensating a minor loss of pressure; however, the safety difference pressure switch leads to untimely shutoff of the lamp, as a rule. Such lamps, therefore, can be used only conditionally or not at all in certain work areas.

SUMMARY OF THE INVENTION

The problem of the present invention is to provide a transportable lamp of the type specified above that avoids the known drawbacks and, furthermore, assures its continuous and reliable function.

For solving the problem according to the invention, provision is made that the holding device is designed in the form of a bar and surrounded by the lamp screen at least partly, whereby the lamp screen is supported by movable tensioning means which, in their state of application, are spaced from the lighting means and abut the lamp screen along its curvature.

By using movably arranged tensioning means it is possible to reliably open the lamp screen, which extends at least partly around the holding device or, of course, may completely cover said holding device as well. The tensioning means employed are preferably arranged in this connection in such a way that in the operational state of the portable lamp, they are spaced from the lighting means and abut the lamp screen along its curvature after the screen has been opened. After the portable lamp has been used, the tensioning means can be relieved for the further transport of the lamp, so that the balloon screen collapses within itself and the material used for the lamp screen can be folded together. This results in a handy cylindrical shape of the transportable lamp, which can be stored or transported in the smallest of space. For said reason, such a transportable lamp is particularly well suited for use by fire fighting departments, technical emergency services or other mobile units. The lamp, furthermore, is characterized by a lighting means with high light intensity, so that the preferred field of application of the lamp is outdoors, for sports or cultural events, in connection with accidents or natural catastrophes, or for nighttime work operations. Lighting means in the form of halogen or metal vapor lamps with high light intensity are preferably employed for said lamps, whereby a non-glaring and diffuse light is produced. Furthermore, an adequate large spacing from the lighting means is assured when the screen is open, whereby the radius of the lamp screen is predetermined by the tensioning means. Therefore, a safe and reliable operation of the lamp is achieved owing to the spring-tensioned lamp screen particularly because no monitoring of the pressure is required within the interior of the lamp screen.

It is possible, furthermore, to use the lamp in recovery and rescue operations; as a mobile tent lighting lamp, asia film or photo lamp, and possibly as a military lamp. The lamp is particularly suited for transport in a passenger motor vehicle because of its high portability.

In order to avoid a glaring effect, provision is made according to a first embodiment of the invention that the lamp shade consists of an ellipsoidal to spherical balloon cover, which completely surround the lighting means. By designing the lamp cover in the form of a completely closed balloon it is possible to use such a lamp, for example as a road construction site lighting device in road traffic without dazzling the passing traffic. Furthermore, glare is reduced in such a way that not only objects or persons are seen in the cone or beam of the light, but areas located behind the lamp can be inspected as well. This makes it possible, for example to see hand signs or the like made by persons.

According to a further development of the invention, provision is made that the balloon cover consists of two halves, of which the upper half preferably consists of a reflecting textile material, and the lower half of a transparent, for example translucent material, which assures downward concentration of the light.

Owing to the utilization of said materials, an absolutely glare-free diffuse light is produced even in connection with extremely intensive lighting means such as halogen or metal vapor lamps, which permits a person to directly look into the light without being dazzled. With the lamp as defined by the invention, a glare-free and low-shadow light with high light intensity is achieved for a portable, foldable lamp, such light having a quality as it has been possible to achieve heretofore only with stationary lamps with milk glass or otter diffusing materials. In addition to reducing glare, the light produced by the textile balloon cover also reduces the heavy shadow caused by the projection of objects onto backgrounds. Diffuse lighting conditions similar to daytime light are created, whereby said special properties lead to useful lighting of construction sites, locations where recovery or rescue operations are carried out, in movie production locations, and for other purposes, where high light intensity has to be produced with portable lighting equipment.

For the purpose of facilitating replacement of the lighting means, provision is made according to an advantageous embodiment of the invention that the two halves of the balloon cover are joined with each other, for example by means of a Velcro® closure, a strip of buttons, or a zipper. The Velcro® closure thus permits separation of the two halves of the balloon and access to the interior of the portable lamp, for example for replacing the lighting means. Moreover, the halves of the balloon cover can be combined in different ways, if need be, or the one or other half of the balloon cover can be replaced in case of damage without major problems.

According to a particular embodiment of the invention, provision is made that the tensioning means consists of a plurality of springs, for example spring steel wires, flat spring strip, fiber glass or carbon rods. The use of springs effects in a simple and effective manner safe opening of the balloon cover, which is maintained even if the textile cover gets damaged. At least three or more tensioning elements are arranged for said purpose around the periphery of the holding device. Four or six springs are preferably used, whereby, however, a substantially greater number of springs can be readily used as well. Decisive for the number of springs employed is the size of the balloon cover, so that a lower number of individual springs can be used with smaller-sized transportable lamps, and preferably a greater number of with larger transportable lamps.

So as to assure the mobility of the springs and to facilitate the tensioning process, provision is made according to another advantageous embodiment of the invention that the springs are pivot-mounted on the upper and lower balloon halves.

According to yet another development of the invention, provision is made that at least at one end, the holding device consists of a rod with a square cross section and made of aluminum or steel, and that in the center, the lighting means is received in a lamp socket. By using a square cross section at least at one end of the holding device, it is possible to push on and mount a holding element, which is retained locked against rotation and thus prevents the tensioning means or springs from getting twisted. The holding element can be axially fixed in this connection on the holding device in a number of positions by means of a locking device, for example in the form of a click-stop type bolt lock, which allows the lamp or balloon cover to be opened to varying degrees. A locking means is required also because the tensioned, opened balloon cover would displace the springs together with the holding element on account of the existing counter pressure and thus cause relief to occur.

With a preferred embodiment of the transportable lamp, provision is made that a handle is arranged at the one end, and a holding element with torsional strength, but axially displaceably at the other end. The lamp thus can be safely held via the handle and opened after releasing the click-stop locking means and shifting the holding element. In a particularly preferred embodiment of the lamp, provision is made that the tensioning means are pivot-mounted at the end sides on the handle or socket of the lamp, on the one hand, and on the holding element on the other, whereby the handle or the lamp socket are equipped in their surfaces, faces or peripheral surfaces facing one another with a multitude of corresponding hinges for receiving the springs. Therefore, by mounting the springs in such an articulated way, optimal adaptation of the spring elements to the balloon cover is made possible when the holding element is displaced on the holding device, and uniform stressing of the balloon cover is achieved at the same time because the contact pressure is uniformly distributed across the periphery. Depending on the initial tension of the springs, the latter assume a curved shape in relation to the center axis of the holding device and rest tensioned against the inner side of the balloon cover. A ball-shaped or ellipsoidal form of the balloon cover is obtained depending on the extent to which the holding element is displaced.

According to another development of the invention, provision is made that the springs are additionally received in sewn-in pockets of the balloon cover. The balloon cover can be folded together automatically in this way.

Furthermore, so that the transportable lamp can be fastened in an elevated position, provision is made that the bottom end of said lamp can be plugged into a lamp holder.

Therefore, the goal achieved with the present invention is that owing to the technical design of the lamp screen construction and the material selected for the balloon, the balloon lamp produces a pleasant glare-free and diffuse light even with high-intensity lighting means. The high portability of the lamp has to be viewed as another benefit, such portability being provided due to the fact that the balloon of the lamp can be folded together or relieved. At the site where it is used, the lamp can be provided with the desired shape of the balloon through initial tensioning of the balloon and by simply displacing the holding element on the center axis of the holding device. Damaging of the balloon cover by the lighting means is almost totally excluded due to the large spacing between the lighting means and the balloon cover, and, furthermore, by using the tensioning means, permanent opening of the balloon cover is advantageously assured even if the balloon cover get damaged externally.

BRIEF DESCRIPTION OF THE DRAWINGS

The invention is explained in greater detail in the follow with the help of the drawings, in which.

DETAILED DESCRIPTION OF THE PREFERRED EMBODIMENT

Figure 1:
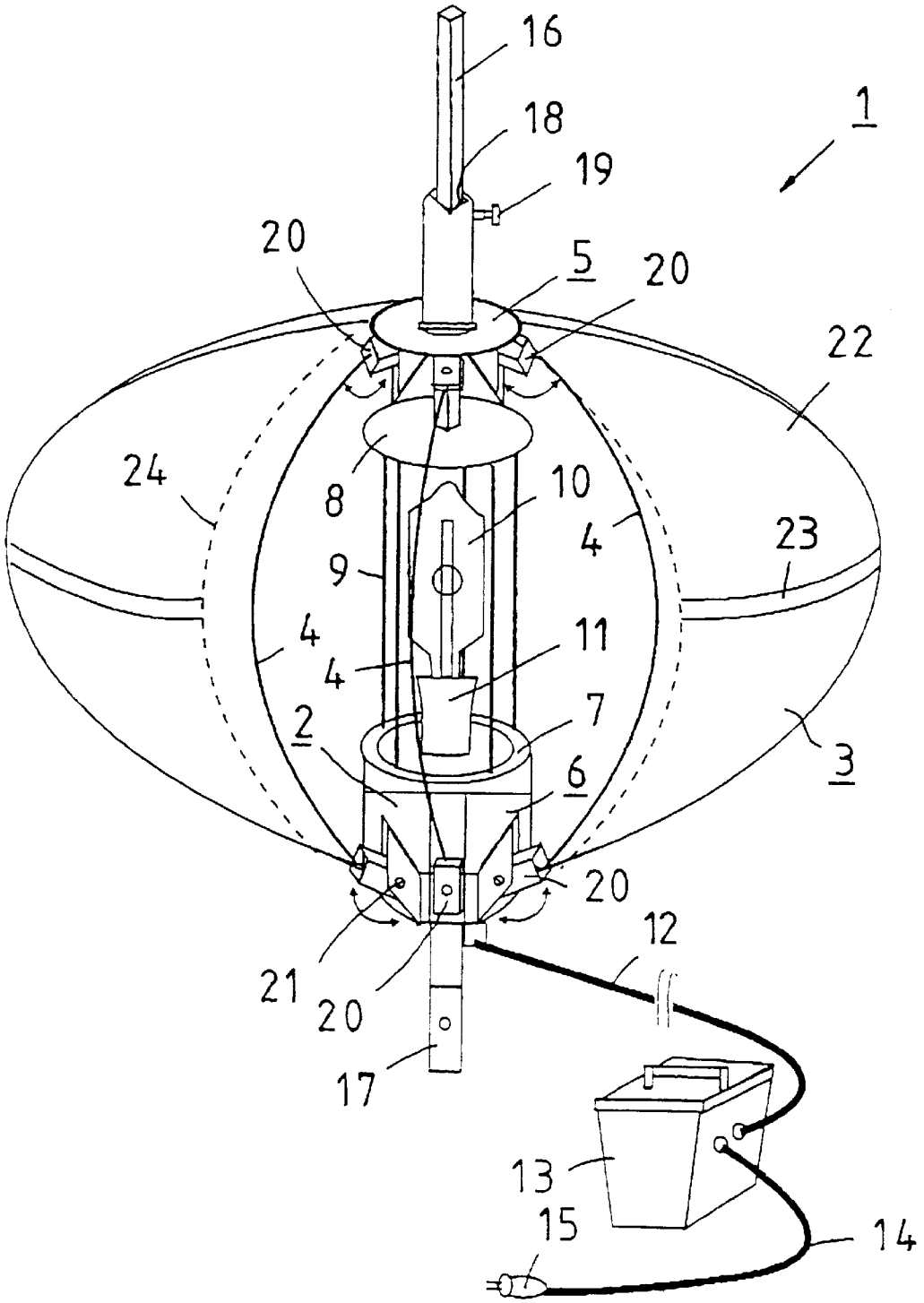
FIG. 1 is a side view of the transportable lamp as defined by the invention, with the balloon cover shown opened.

FIG. 1 shows the lamp 1 as defined by the invention by a side view. Said lamp consists of a rod-like holding device 2 and a lamp screen 3. The lamp screen 3 is opened up and assumes its opened form via the tensioning means 4 which, for example, may consist of spring steel wire, spring steel strip material, fiber glass or carbon rods, whereby the tensioning means 4 are secured pivot-mounted at the one end on a holding element 5 above the holding device, and at the other end secured pivot-mounted on a lamp socket 6.

In its center zone, the holding device 2 has the lamp socket 6, which consists of a lower hollow cylinder 7, an upper sheet metal cover plate 8, and the rods 9 which are distributed over the periphery and connect the cylinder 7 and the sheet metal cover plate 8. The rods 9 extend parallel with the longitudinal expanse of the holding device 2 and serve the purpose of protecting the inserted lighting means 10. The lighting means 10 is received in a socket 11, which projects into the hollow cylinder and, if need be, is secured on a cylinder bottom. Furthermore, said socket 11 is connected to the current feed cable 12 by way of contact connections, which are disposed covered. The current feed cable 12 leads to a transformer 13, which can be connected to the local power network via a power feed cable 14 and a mains plug 15. As an alternative, it is possible to use via the feed cable 12 a battery instead of the transformer 13 if another lighting means 10 is used. However, a series-connected implement can be omitted if a halogen lamp is employed.

Furthermore, the holding device 2 has at least one square bar 16 located above the lamp socket 6. A handle 17 is secured below the lamp socket 6. Instead of using a square bar 16 it is possible to employ another edged or oval shape of said bar provided that turning of the holding element 5 slipped over the top of said bar is avoided in order to prevent the tensioning means 14 from getting twisted. The holding element 5 has a corresponding recess 18, in which the upper square bar 16 is guided. Furthermore, the holding element 5 is equipped with a clip-in pin type lock 19, which engages the bores 27 in the square bar 16. However, it is possible also to use a set screw which permit clamping of the holding element 5 on the square bar 16 by the counter pressure generated. The clip-in pin lock thus makes it possible to fix the holding element 5 on the upper square bar 16 in different positions.

The holding element 5 and the lamp socket 6 are fitted with a plurality of hinges 20 distributed over the periphery, said hinges being secured pivot-mounted via as bearing pin 21. Furthermore, the ends of he tensioning means 4 are received in each case by two corresponding hinges 20. The clamping means shown in the exemplified embodiment is spring steel wire. Said spring steel wire serving as the tensioning means 4 can be plugged, for example, into the hinges 20 and may be secured by additional auxiliary means, if necessary.

Depending on the position of the upper holding element 5, displacement therefore causes an initial tension to be applied to the tensioning means 4, which leads to an arc-like opening of the individual tensioning means 4. Due to the fact that several tensioning means 4 are arranged distributed over the periphery around the lamp socket 6, an ellipsoidal or spherical opening of the tensioning means 4 is thus effected. The form of the tensioning means 4 can be compared in this connection with the degrees of longitude of the globe. Furthermore, a balloon cover 22 is located above the tensioning means 4, said balloon cover—which is divided in two halves—corresponding with the lamp screen 3. The upper half of the balloon cover 22 consists of, for example a reflecting textile material, whereas the lower half of the balloon cover 22 can be made of a foil, for example a translucent foil. The radiation emitted by the lighting means 10 is reflected in this way from the upper balloon cover 22 downwardly, and a diffuse, low-glare light is produced owing to the translucent design of the lower half of the balloon cover 22. The shape of the balloon cover 22 is substantially preset by the position of the holding element 5 on the upper, square bar 16 and, if the holding element 4 is pushed up, leads to a reduction of the circumference of the balloon cover, or after the lamp 1 has been switched off, the balloon cover can be folded together into a handy cylindrical shape. The two balloon cover halves are connected with each other here by a VELCRO® closure 23 and therefore make it possible to replace only the upper or only the lower half of the balloon cover 22, or to replace the lighting means 10, if necessary. The lower handle 17 can be designed in the form of a tripod pin for securing the lamp 1 on a tripod or on a larger stand, if necessary, whereby the lower handle 17 or tripod pin is connected with the bottom of the hollow cylinder. For the purpose of showing the inner structure of the lamp 1 in a superior way, the balloon cover 22 is cut open along the dashed line 24. In the condition ready for operation, disregarding exceptional cases and special cases of application, the balloon cover 22 extend over 360° around the holding device 2 and thus around the lighting means 10.

Figure 2:
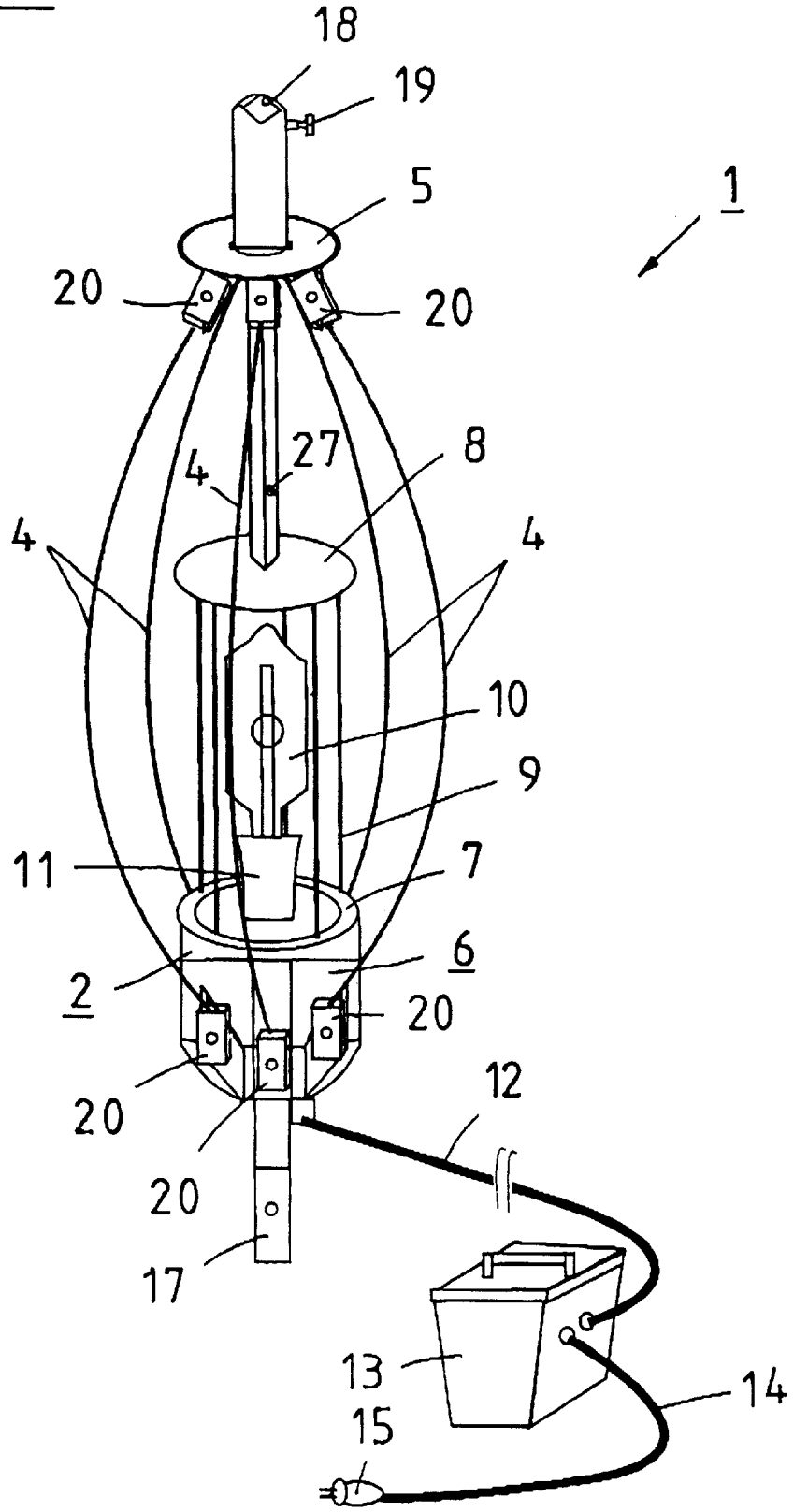
FIG. 2 is a view of the lamp as defined by the invention without the balloon cover.

FIG. 2 shows the lamp 1 as defined by the invention without the balloon cover, whereby the holding element 5 has been pushed upwardly in relation to the lamp socket 6 after the clip-in pin lock 19 had been released. This causes a relief of the tensioning means 4 and, after the lamp 1 has been shut off, causes the tensioning means 4 to come to rest against the lamp socket 6 and, furthermore, permits the baloon cover 22 to be folded together, which, however, is not shown here.

Figure 3:
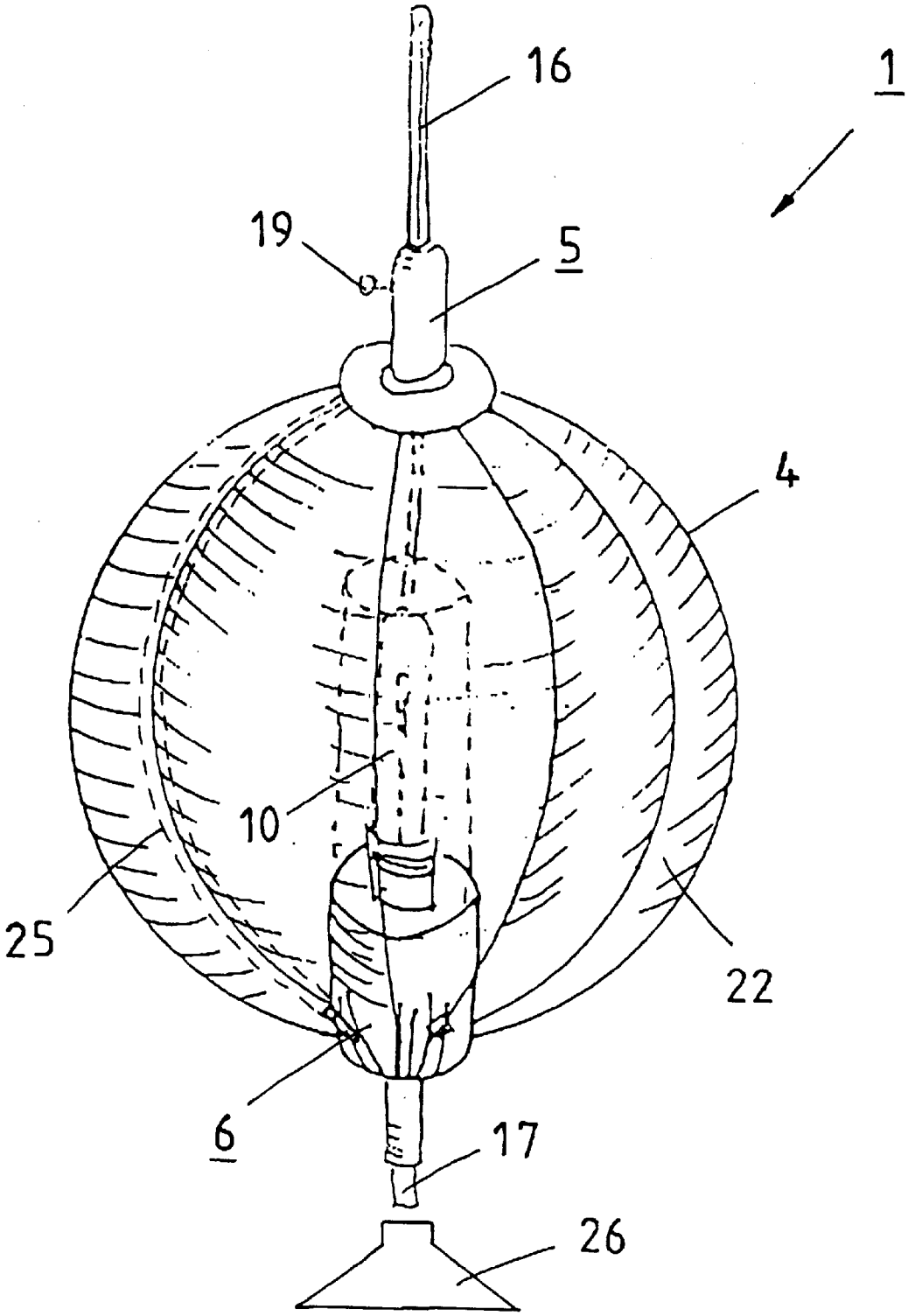
FIG. 3 is a view of the lamp as defined by the invention, with a ball-shaped balloon cover.

FIG. 3 shows the lamp 1 as defined by the invention in the form of a balloon, whereby the lamp socket 6 with the lighting means 10 is shown only schematically. The lamp socket 6 is surrounded by the balloon cover 22, with the latter being tensioned again by the tensioning means 4.

What is claimed is:

1. A portable lamp, comprising:

at least one lighting means;

a holding device, said holding device receiving the lighting means and being acted upon by voltage admitted via a feed cable, wherein one end of the holding device comprises a bar with a noncircular cross-section; and an at least partially transparent lamp shade arranged around the lighting means and held by a movable tensioning means, said tensioning means being spaced from the lighting means during operation of the lamp and resting against a curvature of the lamp shade, wherein said holding device is least partly enclosed by said lamp shade, and wherein said bar prevents said tensioning means from twisting.

2. The portable lamp according to claim 1, wherein the lamp shade comprises an ellipsoidal to spherical-shaped balloon cover completely surrounding the lighting means.

3. The portable lamp according to claim 2, wherein the balloon cover comprises an upper half and a lower half, wherein the upper half is made of a reflecting textile material and the lower half is made of a transparent material.

4. The portable lamp according to claim 3, wherein the two balloon cover halves are joined with each other by a fastener selected from the group consisting of a loop and hook-type closure, a strip of buttons and a zipper.

5. The portable lamp according to claim 4, wherein the tensioning means comprises a plurality of individual springs made of a material selected from the group consisting of spring steel wires, flat spring strip, fiber glass and carbon rods.

6. The portable lamp according to claim 5, wherein there are at least three springs arranged distributed over the periphery of the holding device.

7. The portable lamp according to claim 5, wherein the springs are pivot-mounted on the upper and lower halves of the balloon cover.

8. The portable lamp according to claim 1, wherein said noncircular bar has a square cross section and is made of a material selected from the group consisting of aluminum and steel, and wherein the lighting means is accommodated in the center of the holding device in a lamp socket.

9. The portable lamp according to claim 8, further comprising a handle arranged on said one end of the holding device, and at least one holding element arranged on the other end of the holding device with torsional strength and axial displaceability.

10. The portable lamp according to claim 9, further comprising a locking means comprising a click-stop pin lock for axially fixing the holding element in a plurality of positions on the holding device.

11. The portable lamp according to claim 9, wherein the tensioning means are pivot-mounted on the handle or lamp socket and on the holding element.

12. The portable lamp according to claim 9, further comprising a plurality of hinges for receiving springs provided on facing surfaces of the handle or the lamp socket and the holding element.

13. The portable lamp according to claim 12, wherein the springs have a curved shape in relation to a center axis of the holding means and rest against an inner side of the balloon cover.

14. The portable lamp according to claim 13, wherein the springs are received in sewed-in pockets of the balloon cover.

15. The portable lamp according to claim 1, wherein a bottom end of said lamp is adapted to be plugged into a stand.

* * * * *